United States Patent [19]

Zimmermann

[11] Patent Number: 4,838,539

[45] Date of Patent: Jun. 13, 1989

[54] STACKER FOR LETTERS

[75] Inventor: Armin Zimmermann, Constance, Fed. Rep. of Germany

[73] Assignee: Licentia Patent-Verwaltungs GmbH, Fed. Rep. of Germany

[21] Appl. No.: 129,992

[22] Filed: Dec. 8, 1987

[30] Foreign Application Priority Data

Dec. 9, 1986 [DE] Fed. Rep. of Germany ..... 3642021

[51] Int. Cl.[4] ..... B65H 39/10

[52] U.S. Cl. ..... 271/305; 271/220

[58] Field of Search ..... 271/220, 177, 209, 188, 271/303-305, 224; 209/900

[56] References Cited

U.S. PATENT DOCUMENTS

| | | | |
|---|---|---|---|
| 1,086,353 | 2/1914 | Dick | 271/220 |
| 2,912,925 | 11/1959 | Rabinow | 209/900 |
| 2,916,286 | 12/1959 | Keating | 271/220 |
| 3,630,517 | 12/1971 | Enskat | 271/220 |
| 4,273,325 | 6/1981 | Rodewald | 271/220 |
| 4,388,994 | 6/1983 | Suda | 209/900 |
| 4,493,484 | 1/1985 | Eyer | 271/303 X |

FOREIGN PATENT DOCUMENTS

| | | | |
|---|---|---|---|
| 1296431 | 5/1969 | Fed. Rep. of Germany | 271/224 |

*Primary Examiner*—Richard A. Schacher

*Attorney, Agent, or Firm*—McGlew & Tuttle

[57] ABSTRACT

A stacker for letters and similar flat, flexible conveyed material includes a number of stack compartments to which the letters are fed past shunts assigned separately to the individual compartments and in which the letters are stacked on top of one another, the stack compartments are sloped by a specific angle in the direction of the incoming letters. Each stack compartment has an inlet strap mounted at one end to rotate above the letter inlet opening and to guide the letter into the stack compartment during its energy. The inlet strap has an angle iron shaped cross section, with the ends of the legs pointing in the direction of the stacking space. An additional guide device is provided in the interspace of the inlet strap formed by the legs, which is fastened in the inlet strap in the area of its bearing, and is disposed at a specific angle to the inlet strap in the rest position and can pivot into the interspace formed by the legs of the inlet strap, so that the front edge of an incoming letter slides along the inlet strap, but the rear edge is lowered by the additional guide device.

8 Claims, 3 Drawing Sheets

STACKER FOR LETTERS

FIELD AND BACKGROUND OF THE INVENTION

This invention relates in general to sorting and stacking devices and in particular to a new and useful stacker for letters and similar flat, flexible conveyed material.

In automatic letter distributing systems, the letters are transported singly on a conveyor track for the purpose of reading the place of destination automatically and subsequent sorting, and then they are assigned to a number of stack compartments over a compartment track with shunts corresponding to the postal zip codes, and they are stacked at such locations.

To produce the highest possible throughput, the letters run on the conveyor belt at the highest possible speed and at the shortest possible distances from one another. Under these circumstances, the problem of jamming arises with letters that are assigned to the same stack compartment, which is caused by the front edge of the following letter running into the rear edge of the preceding letter.

It is disclosed by German Patent Application Disclosure No. 33 27 865, for the case of letters resting vertically on their long edges during the stacking, how to have the bottom front edge of the letter run tangentially into a rotating spindle wheel, with the flank of the spindle wheel transporting the following parts of the letter, especially its rear area, toward the letters already stacked, so that the following letter reliably runs into the stack compartment along with the preceding letter.

However, the spindle wheel drive for each stack compartment is very involved and costly. For this reason, it has been attempted for precision distribution systems with a large number of stack compartments and low throughput to avoid the involved spindle wheel method by stacking the letters one on top of the other in the stack compartments, and by having the leading letter drop because of its weight and stiffness alone, using gravity, to such an extent that the following letter is pushed over the leading letter. In this case, however, difficulties arise when the letters, for example airmail letters, are very soft, and the sorting capacity is not to drop below a prescribed value.

SUMMARY OF THE INVENTION

The invention avoids the difficulties mentioned and provides a stacker in which the stacking is made more reliable in simpler letter distributing systems, so that stacking of letters for the same stack compartment is achieved with the greatest possible stacking speed without crowding even with letters of low bending strength.

In accordance with the invention the rear edge of a letter is pressed down by a simple additional guide device, requiring little expense, before encountering the front edge of the following letter to such an extent that the following letter is pushed without hindrance over the preceding letter.

The additional guide device attached to the inlet strap comprises a device of springy material which is advantageously prestressed by means of a coil spring, and it can execute its function using gravity in a very simple way. The invention advantageously includes a guide face connected parallel to the surface of the stacked letters which supports the action of the additional guide device, protects the letters, and deposits the letter in the stack compartment free of folds and creases.

Accordingly it is an object of the invention to provide a stacker for letters and similar flat flexible conveyed material which comprises a plurality of stacked compartments arranged, for example, along an inclined path and which is fed with letters which are deflected by individual shunt devices into specific stacking piles of respective compartments each of which includes an inlet for the letters adjacent which is mounted is a strap having an angle shape cross section with spaced apart legs and which includes a guide device which is pivotally mounted substantially at the same location as the pivotal mounting of the inlet strap and which is positioned in the rest position at an angle to the strap and located so as to deflect particularly the rear ends of the letters downwardly into the stack of each compartment.

A further object of the invention is to provide a stacking device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
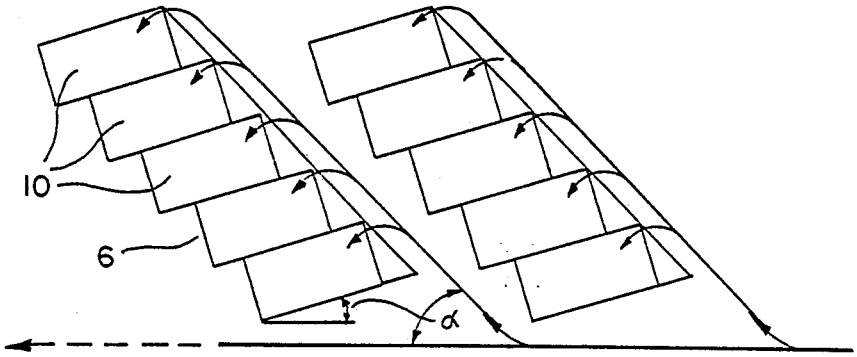
FIG. 1 is a schematic side elevational view of the stacker of a precision distribution system.

Referring to the drawings in particular, the invention embodied therein comprises a stacker for letters and similar flat flexible conveyed material which is includes a plurality of stacked compartments 10 arranged at an angle alpha so they tilt toward a stacking wall (stop wall) 6 into which letters are fed by a conveyor which permit entry of the letters into the compartments by the deflection of a shunt and which includes an inlet strap arranged in the compartment which deflect the letters into the compartment for stacking therein against the lowermost wall and which is further improved by a cutting device 2 which is arranged adjacent the inlet opening 12 to the compartment and which is pivotally mounted about a bearing 13 of the inlet strap 1.

As shown in FIG. 1, two compartment sections of a precision letter distribution system include a large number of low capacity stack compartments 10 arranged on top of one another and beside one another. The stack compartments have a slope of the angle alpha with respect to the horizontal in order to give the parcels such as cards and letters (hereafter called only "letters") a stable rest position against the stop wall 6. The letters are fed in shunts to the stack compartments assigned to their postal zip codes by means of conveyor belts, with their surface perpendicular to the plane of FIG. 1, coming from the right in the direction of the arrow.

Figure 2:
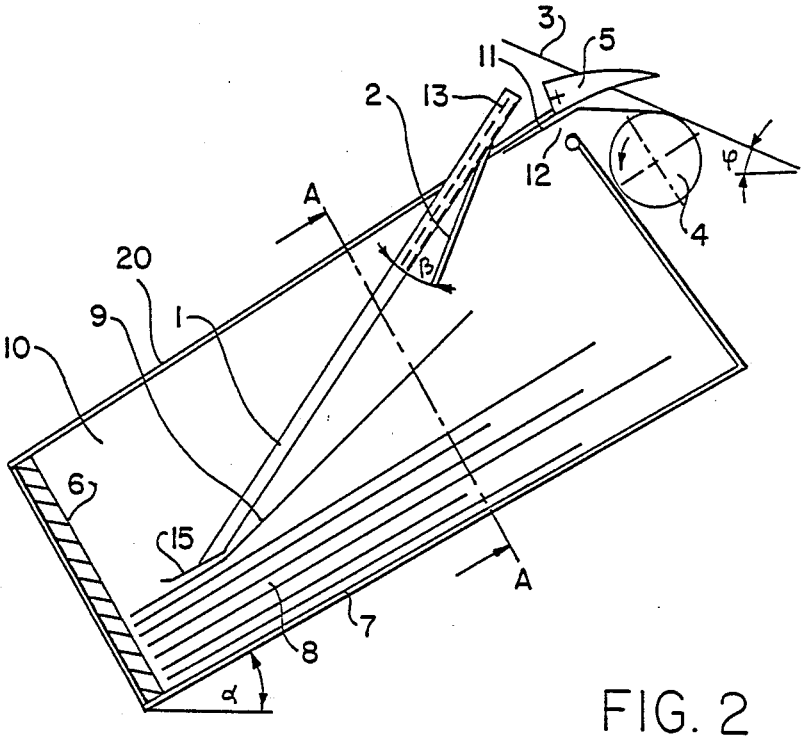
FIG. 2 is an enlarged side elevational view of an individual stack compartment.

FIG. 2 shows an individual stack compartment 10. The letter assigned to the stack compartment is fed to the stack compartment by a so-called cover belt system comprising a conveyor belt 3, and a conveyor roller 4 assigned to each stack compartment 10. The letter is forced to leave the conveyor belt 3 by an appropriately positioned shunt or deflector 5. The letter 11 then runs into the stack compartment through an inlet opening 12, and slides along a cover 20 of the stack compartment and then along the bottom edges of an inlet strap 1, normally over the rear edge of the preceding letter 9, onto the letters 8 already stacked. The slope of the bottom of the stack 7 and thus of the stack compartment 10 by the angle alpha from the horizontal guarantees that the letters slide in an orderly manner to the stop wall 6. The flattened end 15 of the inlet strap 1 presses on the stacked letters at a distance from the stop wall 6, so that each letter that has just run in is caused to drop onto the letters already stacked because of its bending strength.

An air cushion to be displaced and the adhesion of the letters at the inlet strap 1 because of electrostatic charges oppose the dropping of the rear edge of the letter in an undesirable way.

In order to be able to stack even large area parcels of low bending strength and low weight, such as airmail letters, in an orderly manner, the inlet strap 1 has an angle iron-shaped cross section with the opposed ends of the legs pointed downwardly toward the stacking space. This avoids adhesion of the letters to the inlet strap. Furthermore, an additional guide device 2 is provided in the interspace formed by the opposed legs of the inlet strap 1. The device 2 is fastened to the inlet strap 1 in the area of its bearing 13. The device 2 make a specific angle "beta" with the inlet strap 1 in its rest position. The device 2 can pivot in the interspace between the angle iron-shape of the inlet strap 1 lower opposed legs.

When the letter 11 runs in, it strikes the additional guide device 2 and presses it into the interspace formed between the opposite legs of the inlet strap 1. During the process, the rear section of the letter is still gripped by the conveyor roller 4 and the conveyor belt 3, so that the letter is not delayed by the impact and by the actuation of the additional guide device 2.

Because of the short lever arm of the letters between the conveyor roller 4 and the additional guide device 2, the bending strength of the letters is sufficient not only to make the front edge of the letter slide along the cover of the stack compartment, but also to make it slide along the lower edge of the inlet strap 1 after pressing in the additional guide device 2. On the other hand, after the rear edge of the letter has left the shunt 5, the force of the additional guide device 2 acts on the rear section of the letter and lowers it to such an extent that the front edge of the following letter runs in an orderly fashion over the preceding letter with the additional guide device 2 again pressed into the inlet strap 1.

The desired deflection force of the additional guide device 2 can be realized by an additional guide device 2 comprising entirely or partly of springy material fastened at one end close to the end 13 of the inlet strap 1, and assuming the angle beta between the inlet strap 1 and the additional guide device 2 shown in FIG. 2, without the effect of external force.

Figure 3:
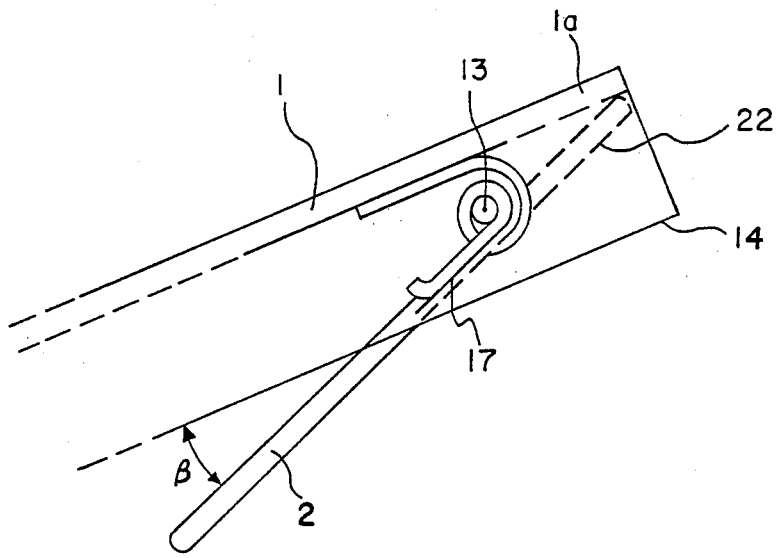
FIG. 3 is a side view similar to FIG. 2 of the mounting of another embodiment with an additional guide device and a spring in the stack strap.
Figure 4:
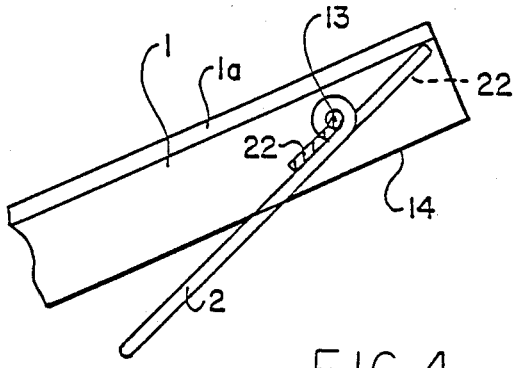
FIG. 4 is a side view similar to FIG. 3 without a spring.

Another simple form of embodiment is shown enlarged in FIG. 3. It provides that the additional guide device 2 and the inlet strap 1 have the same axes of rotation 13. The additional guide device and the inlet strap 1 are double-ended levers, each with a short lever arm 22 or 14, respectively. The short lever arm 22 of the additional guide device 2 is then shaped so that when the angle beta is assumed between the additional guide device 2 and the inlet strap 1, the short lever arm 22 of the additional guide device 2 rests against a top portion 1a of the inlet strap and thereby determines the angle beta. A coil spring 17 deflecting the additional guide device 2 can be provided on the bearing 13 to spread the additional guide device 2 by the angle beta and to apply the desired deflection force.

Another form of embodiment of the additional guide device 2 preferably accomplishes its purpose without an additional coil spring, and uses the force of gravity as the deflection force.

Figure 5:
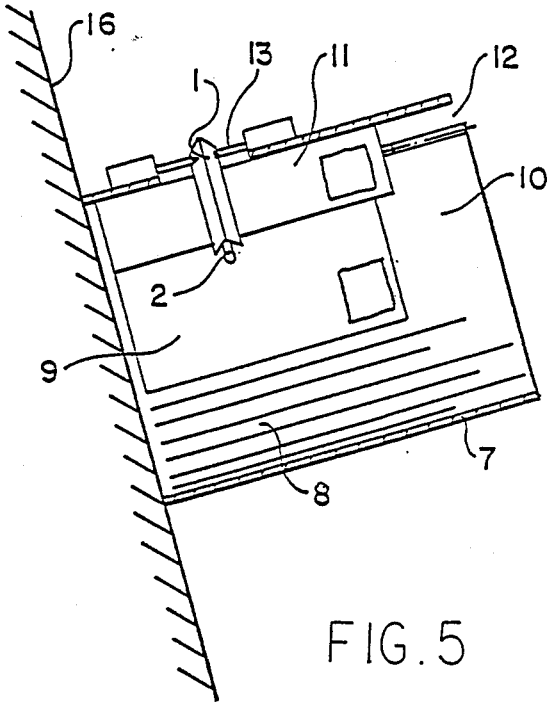
FIG. 5 is a section taken along 1 line A—A of the stack compartment of FIG. 1.

The section A—A of the stack compartment shown in FIG. 2 is illustrated in FIG. 5. The angle iron-shaped profile of the inlet strap 1 is clearly recognizable in this illustration, and the additional guide device 2 placed in the interspace that is formed by the legs of the inlet strap, as well as the bearing 13 for the inlet strap 1 and optionally for the additional guide device 2.

The sloped back wall that the stack compartment 10 carries is identified with 16, and provides for a second definite position of the stacked letters 8 by its slope.

The action of the additional guide device 2 is supported by the design of the long end 15 of the inlet strap 1. It is beneficially flattened into a sliding face, with the slide face being oriented almost parallel to the surface of the stacked letters. A slight arching of the slide face in the direction of the longitudinal axis of the inlet strap beneficially produces a uniform frictional force on other entering letters, independently of the height of the stacked letters.

What is claimed is:

1. A stacker for letters and similar flat, flexible conveyed material, comprising a plurality of stacked compartments to which the letters are fed successively in edge-to-edge relation, means mounting said compartments so that they are inclined at a specific angle in respect to the incoming letters, each stack compartment having an inlet end with an inlet opening adjacent said inlet end, a strap pivotally mounted adjacent said inlet end for rotation above the inlet opening for the receipt of letters by engagement with a front, leading edge of a leading letter in order to guide each letter face down in succession to the stack compartment, said inlet strap having an angle shaped cross section with spaced legs having leg ends pointing toward the stacking space, a pivot bearing pivotally supporting said strap adjacent said inlet opening and an additional guide device located in the interspace between said legs of said inlet strap and pivotally positioned in the vicinity of said pivot bearing, said additional guide device being of less pivoting length than the strap and making a specific angle in respect to said inlet strap in a rest position and being pivotable into the interspace between said legs of said inlet strap by engagement with said front, leading edge of said leading letter and pivotable away from the interspace in engagement with a portion of said leading letter space rearwardly of said front, leading edge.

2. A stacker according to claim 1, wherein said additional guide device includes at least at a part thereof of a springy material.

3. A stacker according to claim 1, wherein said guide device is mounted on said pivot bearing for pivotal movement along with said strap, each of each strap and said additional guide device comprising a double armed lever including a short lever arm portion extending toward said inlet opening, said arm portion of said guide device being positioned so that when it assumes a specific angle in respect to said strap it touches a portion of said strap and rests against said inlet strap and establishes a second angle in respect of said guide device in respect to said strap.

4. A stacker according to claim 1, including a spring acting on said guide device and biasing it to an angle in respect to said strap.

5. A stacker according to claim 1, wherein said inlet strap is of a construction such that it is pivoted so a lower end thereof extends onto said stack under the influence of gravity.

6. A stacker according to claim 1, wherein said strap and said additional guide device are each double arm levers having long arm portions extending downwardly into said compartment, the lower end of said strap having a sliding face oriented substantially parallel to the surface of the stack.

7. A stacker according to claim 6, wherein said sliding face is arched in the direction of the longitudinal axis of said inlet strap.

8. In a stacker for letters of low bending strength and comprising a plurality of low capacity stacking compartments for retaining letters stack in face-to-face relation one on top of another;

each compartment having spaced apart front and rear walls extending between a top and a stack supporting base;

a letter inlet provided at the rear wall adjacent the top;

means to feed letters one-by-one, front edge first, into the inlet to extend face down across the compartment towards the front wall;

a first deflector pivotally mounted adjacent the rear wall to extend across the compartment towards the front wall and biased towards the base for pivotal movement away from the base by engagement of a letter edging portion of the first deflection with a leading edge of a letter entering the compartment through the inlet thereby to deflect the leading edge of the letter downwardly towards the base stack with the trailing end of the letter spaced apart from the base stack;

a second deflector extending side-by-side and pivotally mounted in a similar fashion to the first deflector and biased to extend towards the base at an angle to the first deflector;

the second deflector having a letter engaging portion spaced rearwardly, as measured in the direction of letter travel, from the first deflector whereby the second deflector will initially be pivoted away from the base into alignment with the first deflector by engagement with said leading edge of the letter but will subsequently pivot away from the first deflector towards the base when the trailing edge of said letter is free from the inlet thereby to urge said trailing edge of said letter clear of the inlet, downwardly through the space towards the base stack.

* * * * *